US006460658B2

(12) United States Patent
Suga et al.

(10) Patent No.: US 6,460,658 B2
(45) Date of Patent: Oct. 8, 2002

(54) ELEVATOR CONTROL APPARATUS

(75) Inventors: Ikuro Suga, Tokyo (JP); Hiroshi Araki, Tokyo (JP); Shinobu Tajima, Tokyo (JP); Kazuyuki Kobayashi, Tokyo (JP)

(73) Assignees: Mitsubishi Denki Kabushiki Kaisha, Tokyo (JP); The Tokyo Electric Power Company Incorporated, Tokyo (JP)

( * ) Notice: Subject to any disclaimer, the term of this patent is extended or adjusted under 35 U.S.C. 154(b) by 0 days.

(21) Appl. No.: 09/771,930

(22) Filed: Jan. 30, 2001

(65) Prior Publication Data

US 2001/0017234 A1 Aug. 30, 2001

(30) Foreign Application Priority Data

Feb. 28, 2000 (JP) ..... 2000-051943

(51) Int. Cl.[7] ..... B66B 1/06
(52) U.S. Cl. ..... 187/290; 187/296
(58) Field of Search ..... 187/290, 293, 187/296, 297; 320/112, 113, 129, 132, 134, 150; 312/375, 376, 377; 307/66, 69

(56) References Cited

U.S. PATENT DOCUMENTS 4,252,217 A * 2/1981 Benjamin ..... 187/9 R
4,316,097 A * 2/1982 Reynolds ..... 307/66
4,456,097 A * 6/1984 Salihi ..... 187/29 R
4,666,020 A * 5/1987 Watanabe ..... 187/114
5,712,456 A 1/1998 McCarthy et al. ..... 187/290
5,936,375 A 8/1999 Enoki ..... 318/727
6,315,081 B1 * 11/2001 Yeo ..... 187/290

FOREIGN PATENT DOCUMENTS

JP 61-267675 11/1986
JP 05294568 A * 5/1993
JP 5-338947 12/1993
JP 7-252040 10/1995
JP 10-67469 3/1998
JP 11-217193 8/1999

* cited by examiner

*Primary Examiner*—Jonathan Salata
(74) *Attorney, Agent, or Firm*—Leydig, Voit & Mayer, Ltd.

(57) ABSTRACT

An elevator control apparatus includes a power storage unit for storing the DC power; a charge/discharge control circuit that controls a state of charge of the power storage unit, outputs a drive signal to charge the power storage unit with the DC power during a halt of the elevator based on operational information regarding the elevator received from the controller, and outputs a stop signal to stop charging when a voltage of the power storage unit reaches a preset voltage; and a charge/discharge circuit for starting charging the power storage unit with the DC power in response to the drive signal, and stopping the charging in response to the stop signal. This arrangement ensures landing of the elevator in case of a power failure, eliminates a peak in power consumption, and permits energy saving by effectively using power produced in a regenerative mode of the elevator.

5 Claims, 6 Drawing Sheets

ELEVATOR CONTROL APPARATUS

BACKGROUND OF THE INVENTION

1. Field of the Invention

The present invention relates to an elevator control apparatus utilizing a power storage unit.

2. Description of the Related Art

A conventional elevator control apparatus will be described with reference to an accompanying drawing. FIG. 8 shows a construction of a conventional elevator control apparatus disclosed, for example, under a title of "Redesigned medium-to-low speed passenger elevator, Grandy" on page 9 of Mitsubishi Denki Giho (written by Ando, Kimura, and Mori, Vol. 70, No. 11 issued in 1996).

The conventional elevator control apparatus shown in FIG. 8 includes a commercial three-phase AC power source 1, a motor 2, such as an induction motor IM, a hoisting machine 3, a rope 4, an elevator car 5, a counterweight 6, an encoder 7, a controller 8, a converter 9 formed of a diode or the like, a capacitor 10, a current detector 11, such as a current transformer (CT), an inverter 12, an inverter control circuit 13, a gate drive circuit 14, a regenerative resistor 15, and a switching means 16, such as an IGBT.

An operation of the aforesaid conventional elevator control apparatus will now be described with reference to the drawing.

The hoisting machine 3 is driven by the motor 2 to move the elevator car 5 and the counterweight 6 connected to both ends of the rope 4, thereby carrying passengers in the car to a predetermined floor.

The converter 9 rectifies AC power supplied from the commercial power source 1 to convert it into DC power, which is stored in the capacitor 10. The DC power is converted into AC power of a variable voltage and a variable frequency by the inverter 12.

The controller 8 controls starts and stops of the elevator and also creates commands for start and stop positions and speed. Based on a speed command supplied by the controlled 8, the inverter control circuit 13 rotationally drives the motor 2 by reflecting current feedback from the current detector 11 and speed feedback from the encoder 7 mounted on the hoisting machine 3, thereby implementing the position and speed control of the elevator. At this time, the inverter control circuit 13 controls output voltages and frequencies of the inverter 12 via the gate drive circuit 14.

The counterweight 6 of the elevator is set such that it is balanced when the car 5 is loaded with a moderate number of passengers. For example, when the elevator travels in a balanced state, it is possible to increase the speed of the elevator while consuming electric power in an acceleration mode, and to turn accumulated speed energy back into electric power in a deceleration mode. In typical elevators, however, the regenerative electric power is consumed by being converted into heat energy by the regenerative resistor 15 by controlling the switching means 16.

The conventional elevator control apparatus described above operates the elevator by constantly supplying electric power from the commercial power source. This has been posing a problem in that the operation of the elevator cannot be performed in case of a power failure of the commercial power source, and power consumption cannot be reduced even during a peak time zone of consumption of electric power.

There has been another problem in that the electric power produced during a regenerative mode of the elevator is thermally consumed by a regenerative resistor and cannot be effectively used.

SUMMARY OF THE INVENTION

The present invention has been made with a view toward solving the problems mentioned above, and it is an object of the present invention to provide an elevator control apparatus capable of landing in case of a power failure, eliminating a peak when power is used, and achieving energy saving by effectively utilizing electric power generated in a regenerative mode of an elevator.

To this end, according to one aspect of the present invention, there is provided an elevator control apparatus including: a converter for rectifying AC power into DC power; an inverter for converting the DC power into AC power of a variable voltage and a variable frequency; a controller for controlling a motor based on the AC power of the variable voltage and the variable frequency so as to operate an elevator; a power storage unit for storing the DC power; a charge/discharge control circuit that controls a state of charge of the power storage unit, outputs a drive signal to charge the power storage unit with the DC power during a halt of the elevator based on operational information regarding the elevator received from the controller, and outputs a stop signal to stop charging when a voltage of the power storage unit reaches a preset predetermined voltage; and a charge/discharge circuit for starting charging the power storage unit with the DC power in response to the drive signal, and stopping the charging in response to the stop signal.

In a preferred form of the present invention, the elevator control apparatus further includes temperature detecting means for detecting a temperature of the power storage unit, and the charge/discharge control circuit changes the predetermined voltage based on the temperature of the power storage unit detected by the temperature detecting means.

In another preferred form of the elevator control apparatus according to the present invention, the charge/discharge control circuit corrects the state of charge of the power storage unit when a voltage of the power storage unit reaches the predetermined voltage.

According to another aspect of the present invention, there is provided an elevator control apparatus including: a converter for rectifying AC power into DC power; an inverter for converting the DC power into AC power of a variable voltage and a variable frequency; a controller for controlling a motor based on the AC power of the variable voltage and the variable frequency so as to operate an, elevator; a power storage unit for storing the DC power; a charge/discharge circuit for charging the power storage unit or causing the power storage unit to discharge according to a drive signal; and a charge/discharge control circuit that controls a state of charge of the power storage unit, outputs a drive signal for charging the power storage unit or causing the power storage unit to discharge, and corrects the state of charge based on an open circuit voltage of the power storage unit when a preset predetermined time elapses from completion of discharging from the power storage unit for operating the elevator.

According to yet another aspect of the present invention, there is provided an elevator control apparatus including: a converter for rectifying AC power into DC power; an inverter for converting the DC power into AC power of a variable voltage and a variable frequency; a controller for controlling a motor based on the AC power of the variable voltage and the variable frequency so as to operate an elevator; a power storage unit for storing the DC power; a charge/discharge circuit for charging the power storage unit or causing the power storage unit to discharge according to a drive signal; and a charge/discharge control circuit that controls a state of charge of the power storage unit, outputs a drive signal for charging the power storage unit or causing the power storage unit to discharge, and corrects the state of charge based on an open circuit voltage of the power storage unit when a preset predetermined time elapses from completion of charging the power storage unit.

In a preferred form of the present invention, the elevator control apparatus further includes temperature detecting means for detecting a temperature of the power storage unit, and the charge/discharge control circuit corrects the state of charge based on the temperature of the power storage unit detected by the temperature detecting means and the open circuit voltage.

According to a further aspect of the present invention, there is provided an elevator control apparatus including: a converter for rectifying AC power into DC power; an inverter for converting the DC power into AC power of a variable voltage and a variable frequency; a controller for controlling a motor based on the AC power of the variable voltage and the variable frequency so as to operate an elevator; a power storage unit for storing the DC power; a charge/discharge circuit for charging the power storage unit or causing the power storage unit to discharge according to a drive signal; charge target indicating means for indicating a target value for charging the power storage unit; and a charge/discharge control circuit that controls a state of charge of the power storage unit, outputs a drive signal for charging the power storage unit or causing the power storage unit to discharge, and controls the charge/discharge circuit so as to cause the power storage unit to discharge for a purpose other than operating the elevator if the state of charge indicates that a charge level is higher than the charge target value.

According to another aspect of the present invention, there is provided an elevator control apparatus including: a converter for rectifying AC power into DC power; an inverter for converting the DC power into AC power of a variable voltage and a variable frequency; a controller for controlling a motor based on the AC power of the variable voltage and the variable frequency so as to operate an elevator; a power storage unit for storing the DC power; a charge/discharge circuit for charging the power storage unit or causing the power storage unit to discharge according to a drive signal; a charge/discharge control circuit that outputs a drive signal for charging the power storage unit or causing the power storage unit to discharge, and transmits the state of charge of the power storage unit; and a remote monitoring unit that is installed at a remote location and controls the state of charge of the power storage unit that has been transmitted.

In a preferred form of the elevator control apparatus according to the present invention, the remote monitoring unit calculates charge current amount efficiency at the time of remote monitoring by measuring a charge amount until a preset voltage corresponding to a discharge amount of the power storage unit is reached, and estimates a life of the power storage unit based on the calculated charge current amount efficiency.

According to a further aspect of the present invention, there is provided an elevator control apparatus including: a converter for rectifying AC power into DC power; an inverter for converting the DC power into AC power of a variable voltage and a variable frequency; a controller for controlling a motor based on the AC power of the variable voltage and the variable frequency so as to operate an elevator; a power storage unit for storing the DC power; a charge/discharge circuit for charging the power storage unit or causing the power storage unit to discharge according to a drive signal; displaying means for externally indicating the state of charge of the power storage unit; and a charge/discharge control circuit that outputs a drive signal for charging the power storage unit or causing the power storage unit to discharge, controls a state of charge of the power storage unit, and drives the displaying means to cause the displaying means to indicate the state of charge of the power storage unit.

In a preferred form of the elevator control apparatus according to the present invention, the charge/discharge control circuit corrects the state of charge of the power storage unit when the voltage of the power storage unit reaches the predetermined voltage.

DESCRIPTION OF THE PREFERRED EMBODIMENTS

First Embodiment

Figure 1:
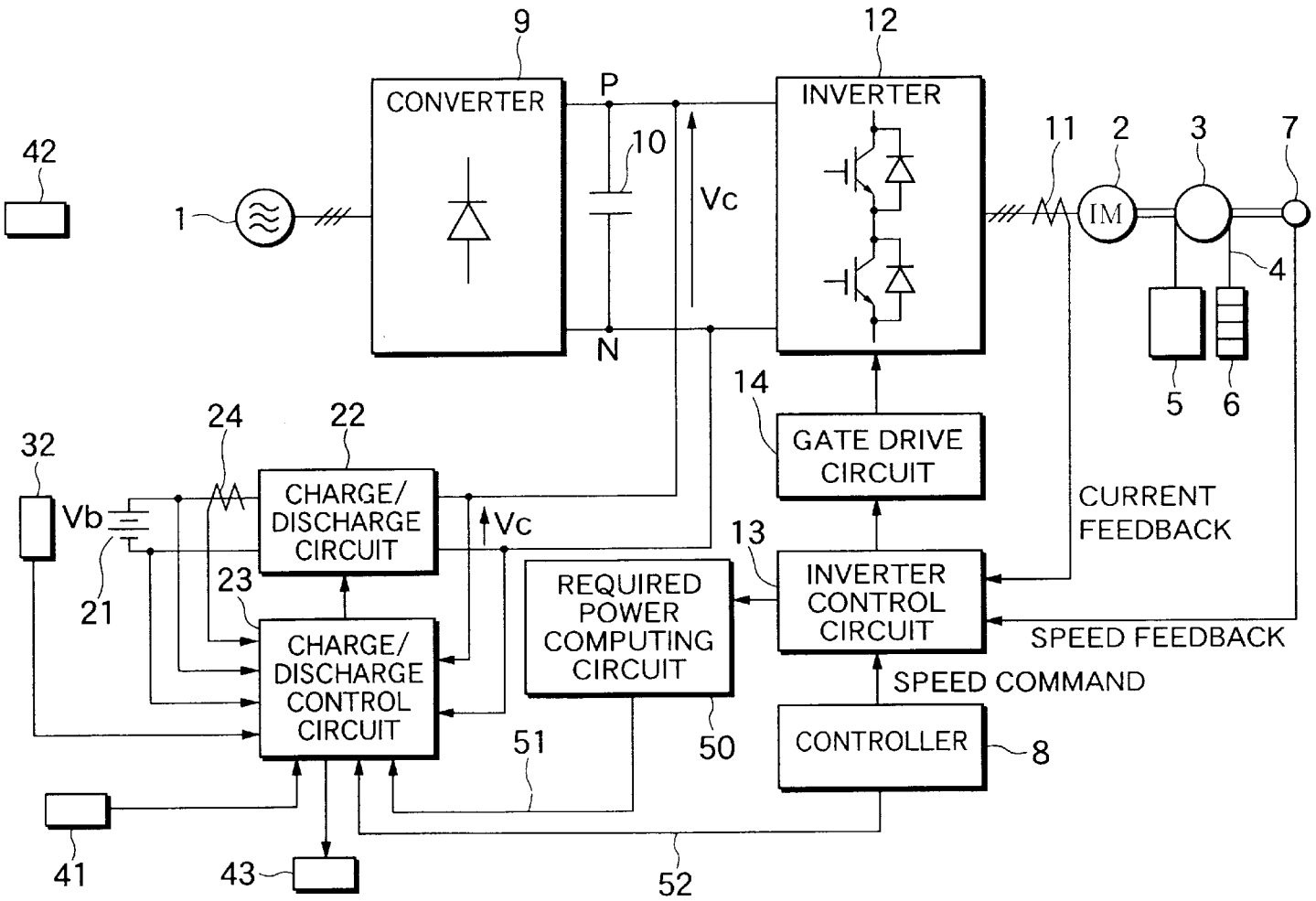
FIG. 1 is a block diagram showing a construction of an elevator control apparatus according to a first embodiment of the present invention.

An elevator control apparatus according to a first embodiment of the present invention will be described in conjunction with the accompanying drawings. FIG. 1 is a diagram showing a construction of the elevator control apparatus according to the first embodiment of the present invention. In the drawings, the like reference numerals will denote like or equivalent components.

Figure 8:
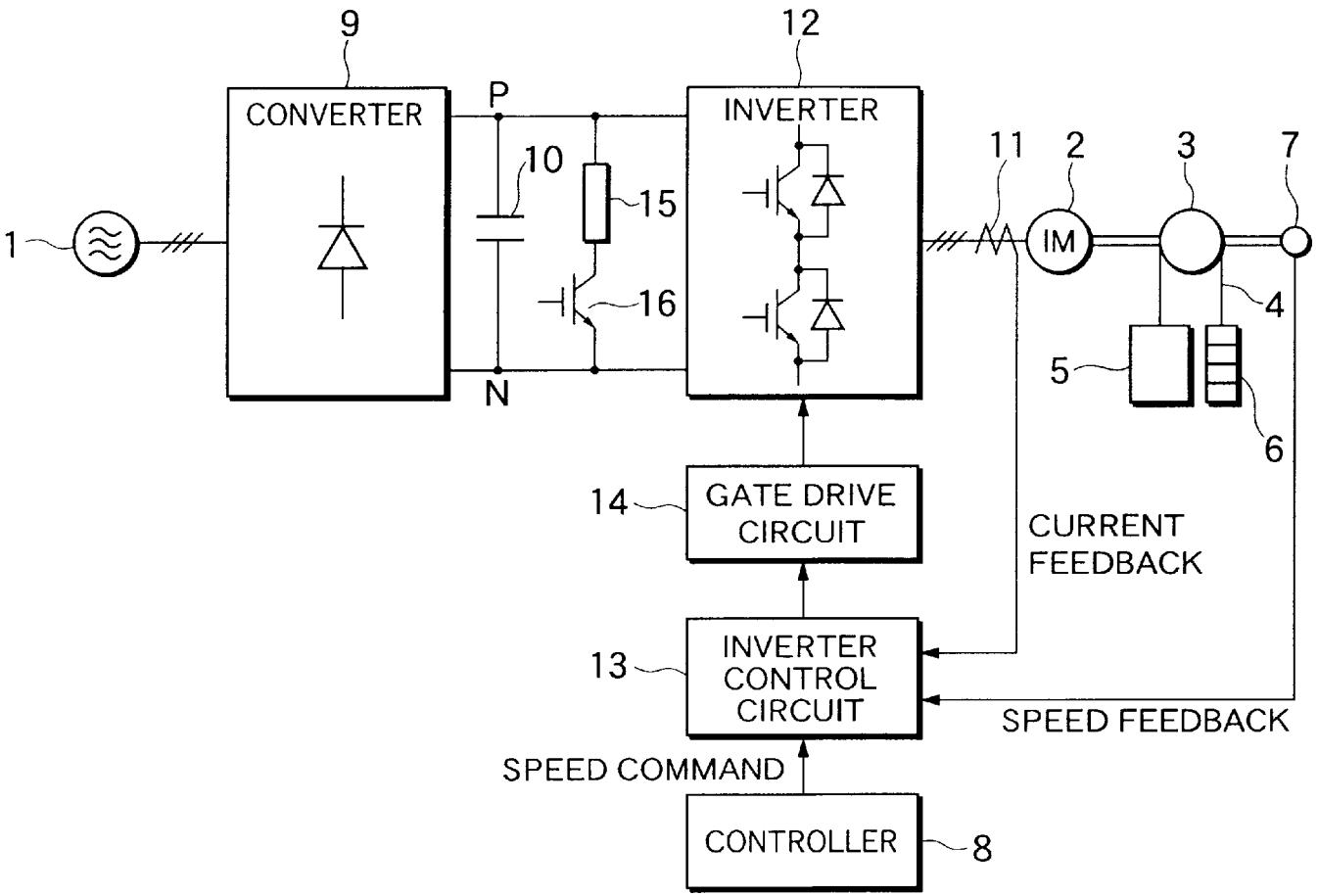
FIG. 8 PRIOR ART
FIG. 8 is a diagram showing a construction of a conventional elevator control apparatus.

A commercial three-phase AC power source 1 through a gate drive circuit 14 in FIG. 1 are equivalent to the like components of FIG. 8 described in the foregoing conventional example.

The elevator control apparatus shown in FIG. 1 further includes a power storage unit 21 composed of a battery or a large-capacitance capacitor, such as an electric double layer capacitor, a charge/discharge circuit 22 composed of a bidirectional DC/DC converter or the like, a charge/discharge control circuit 23 for controlling charge and discharge power of the charge/discharge circuit 22, a current detector 24 which is composed of a current transformer (CT) or the like and which detects an input/output current of the power storage unit 21, a required power computing circuit 50 for computing required power of an elevator, a communication cable 51 for transmitting a signal indicating the required power computed by the required power computing circuit 50, and a communication cable 52 for transmitting signals for starting and stopping the elevator.

Referring to FIG. 1, reference numeral 32 denotes a thermister, reference numeral 41 denotes a charge target indicating device, reference numeral 42 denotes a personal computer, and reference numeral 43 denotes a display device.

Figure 2:
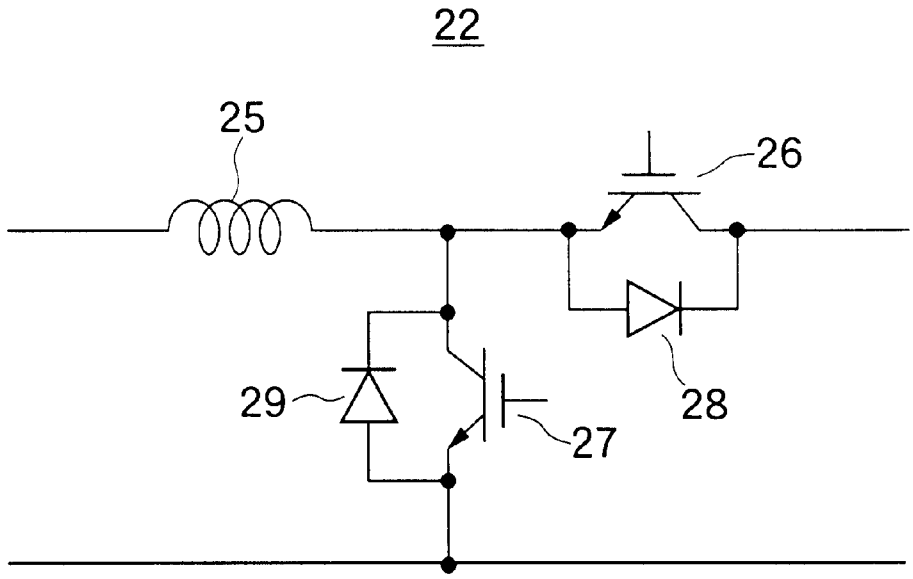
FIG. 2 is a circuit diagram showing a configuration of a charge/discharge circuit of the elevator control apparatus according to the first embodiment of the present invention.

FIG. 2 is a circuit diagram showing a configuration of the charge/discharge circuit 22 of the elevator control apparatus according to the first embodiment shown in FIG. 1.

Referring to FIG. 2, reference numeral 25 denotes a reactor, reference numerals 26 and 27 denote switching devices, such as IGBTs or the like, and reference numerals 28 and 29 denote diodes that are connected inversely in parallel.

The power storage unit 21 is charged by a step-down chopper circuit formed by the switching device 26 and the diode 29. Discharging from the power storage unit 21 is performed by a step-up chopper circuit formed by the switching device 27 and the diode 28.

Figure 3:
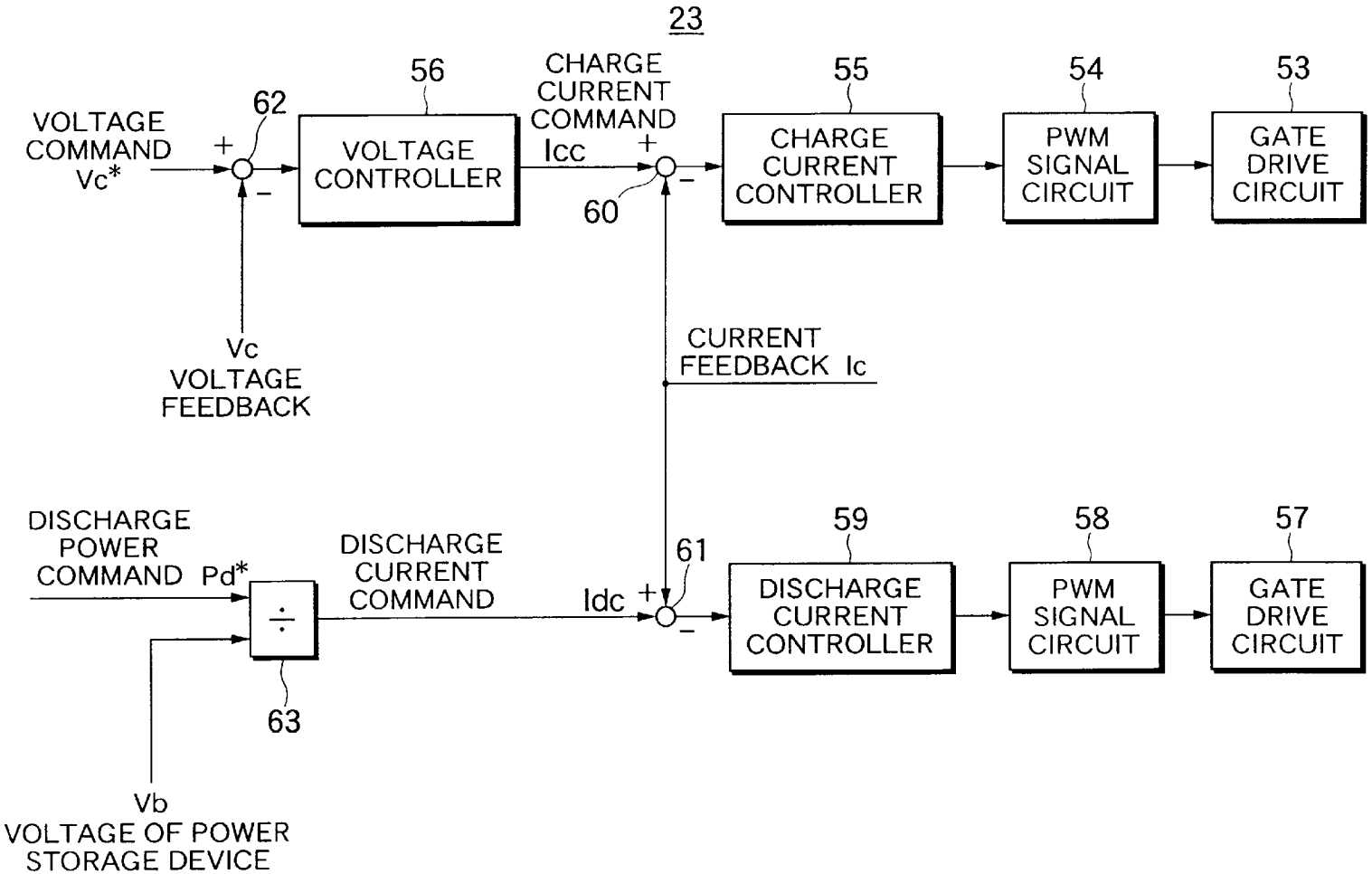
FIG. 3 is a circuit diagram showing a configuration of a charge/discharge control circuit of the elevator control apparatus according to the first embodiment of the present invention.

FIG. 3 is a block diagram showing a configuration of the charge/discharge control circuit 23 of the elevator control apparatus according to the first embodiment shown in FIG. 1.

FIG. 3 further shows gate drive circuits 53 and 57, PWM signal generating circuit 54 and 58 for creating PWM modulation signals, a charge current controller 55 that performs, for example, a proportional integral operation on a difference between a charge current command value Icc and a detected charge current value Ic detected by the current detector 24 so as to control charge current to the charge current command value, a voltage controller 56 that performs, for example, a proportional integral operation on a difference bet ween a voltage command value Vc* and its actual value Vc to control a DC voltage at an input end of the charge/discharge circuit 22 to the voltage command value, and a discharge current controller 59 that performs, for example, a proportional integral operation on a difference between a discharge current command value Idc and a detected discharge current value Ic detected by the current detector 24 so as to control discharge current to the discharge current command value.

In FIG. 3, reference numerals 60, 61, and 62 denote subtractors, and reference numeral 63 denotes a dividing device. The gate drive circuit 53, the PWM signal circuit 54, the charge current controller 55, the voltage controller 56, the subtractor 60, and the subtractor 62 in an upper stage in the drawing make up a control circuit for charge electric power. The gate drive circuit 57, the PWM signal circuit 58, the discharge current controller 59, the subtractor 61, and the subtractor 63 in a lower stage in the drawing make up a control circuit for discharge electric power.

An operation of the elevator control apparatus according to the first embodiment will now be described in conjunction with the accompanying drawings.

If a three-phase AC power source 1 shown in FIG. 1 incurs a power failure, a controller 8 detects the power failure by directly detecting a bus voltage, namely, the voltage Vc between P and N (not shown), or a voltage of the three-phase AC power source 1. The controller 8 transmits the information regarding the detected power failure to the required power computing circuit 50.

Upon detection of the power failure, the required power computing circuit 50 outputs power required for landing the elevator at a nearest floor in the form of a discharge power command Pd* to the charge/discharge control circuit 23. The charge/discharge control circuit 23 outputs a gate drive signal from the gate drive circuit 57 to the charge/discharge circuit 22, as shown in the block diagram of FIG. 3.

The gate drive signal actuates a discharge circuit of the charge/discharge circuit 22 (the discharge circuit is formed by the reactor 25, the switching device 27, and the diode 28) and causes electric power to be supplied from the power storage unit 21 to the inverter 12 so as to run the motor 2 thereby operating the hoisting machine 3. Thus, the elevator car 5 can be landed at the nearest floor. Depending on the number of passengers in the car 5, a charging circuit, which is formed by the reactor 25, the switching device 26, and the diode 29, of the charge/discharge circuit 22 is actuated, and the car 5 is landed at the nearest floor while charging the power storage unit 21 with regenerative electric power from the motor 2.

During a period of time from 13:00 to 16:00, which is a peak time zone of power consumption, all or a part of power from the power storage unit 21 that is required for power running of the elevator is supplied by controlling the discharging circuit of the charge/discharge circuit 22 in substantially the same manner as in the landing in case of a power failure discussed above.

Figure 4:
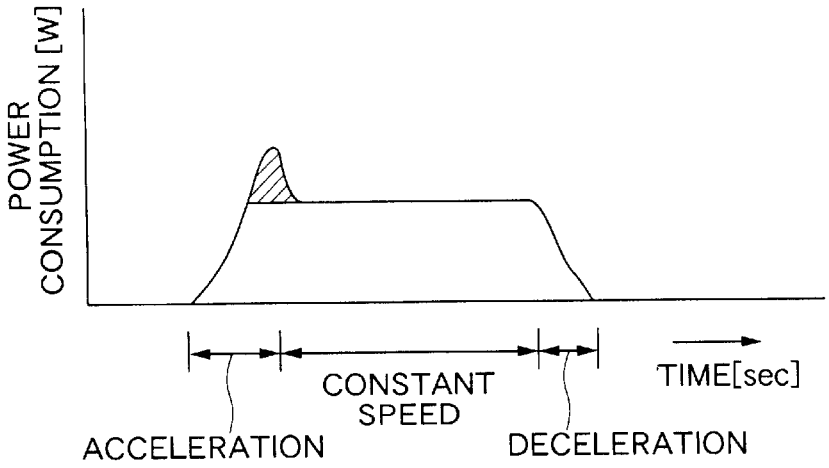
FIG. 4 is a diagram showing electric power consumed during power running of the elevator control apparatus according to the first embodiment of the present invention.

FIG. 4 shows an example of power consumption in a power running mode of the elevator. In the power running mode of the elevator, a peak of power consumption appears during acceleration as shown in FIG. 4. The peak of the power consumption can be eliminated with resultant reduced contract demand by controlling the discharging circuit of the charge/discharge circuit 22 so as to supply the power corresponding to the peak portion of the power consumption, e.g. the hatched portion in FIG. 4, from the power storage unit 21.

In a regenerative operation mode of the elevator, as shown in, for example, the block diagram of the charge/discharge control circuit 23 of FIG. 3, a gate drive signal for controlling the bus voltage Vc to a predetermined voltage is issued from the gate drive circuit 53. This actuates the charge circuit of the charge/discharge circuit 22 to charge the power storage unit 21 with the regenerative electric power from the motor 2.

The charge/discharge control circuit 23 has, in addition to the functions shown in the block diagram of FIG. 3, a function for calculating a charge current amount or charge electric energy, etc. from the charge and discharge current value Ic of the power storage unit 21 detected by the current detector 24 or the voltage Vb of the power storage unit 21 to grasp the state of charge.

The state of charge is controlled so as to always guarantee power required for landing an elevator in case of a power failure. If charging with the regenerative electric power of the elevator is not sufficient, then the power storage unit 21 is charged at a predetermined constant current from the commercial power source 1 through the converter 9 and the capacitor 10 while the elevator is at a halt.

Furthermore, in order to reduce power consumption during the peak time zone of power consumption, namely, from 13:00 to 16:00, the control is carried out to perform the charging by the regenerative electric power of the elevator and the charging at a predetermined constant current from the commercial power source 1 while the elevator is at a halt so as to set the power storage unit 21, at a high charge level by 13:00 . The charging while the elevator is at a halt is performed by actuating the components from the voltage controller 56 and after in the block diagram of the charge/discharge control circuit 23 shown in FIG. 3, thereby performing the charging at a predetermined constant current.

If the state of charge of the power storage unit 21 becomes too high, and if, for example, the state of charge is 100%, then the regenerative electric power of the elevator for charging cannot be effectively used. Furthermore, if the power storage unit 21 is formed by a battery, then a battery voltage suddenly increases, and a gas may be produced in the battery, or deterioration or a shortened life of the battery may result. If the power storage unit 21 is formed by an electric double layer capacitor, then its pressure resistance limit is exceeded, leading to a danger of deterioration, a shortened life, or breakdown or the like.

On the other hand, if the state of charge is below 100%, if the power storage unit 21 is formed by a battery, then the voltage is likely to increase with consequent lower charging efficiency, and acceptability of the regenerative electric power of the elevator due to the high-rate charging. For this reason, in order to prevent the state of charge of the power storage unit 21 from becoming excessively high, charging from the commercial power source 1 while the elevator is at a halt is stopped at a preset voltage. More specifically, the charge/discharge control circuit 23 issues a gate drive signal for stopping the charging to turn OFF the charging circuit (composed of the reactor 25, the switching device 26, and the diode 29) of the charge/discharge circuit 22. This makes it possible to set the state of charge of the power storage unit 21 so that the regenerative electric power of the elevator can be easily accepted.

Thus, the power storage unit 21 is charged while the elevator is at a halt to guarantee landing of the elevator in case of a power failure, and the charging from the commercial power source 1 during a halt of the elevator is stopped at a preset voltage to control the state of charge of the power storage unit 21 thereby to ensure good acceptance of the regenerative electric power of the elevator. This arrangement permits efficient charge of regenerative electric power, advantageously preventing deterioration, a shortened life, and breakdown of the power storage unit 21.

Moreover, the regenerative electric power charged into the power storage unit 21 is effectively discharged by controlling the power storage unit 21, making it possible to save energy, eliminate a power peak by reducing power consumption during a peak time zone of power consumption, and reduce contract demand by reducing the peak power of an elevator with a resultant reduction in electricity rate.

Second Embodiment

A second embodiment of the present invention will be described with reference to the accompanying drawings. A basic construction of the elevator control apparatus according to the second embodiment of the present invention is identical to that of the first embodiment described above. Basic constructions of the third and subsequent embodiments to be discussed hereinafter will also be the same as that of the foregoing first embodiment.

In the first embodiment, the charging at a constant current from the commercial power source 1 while the elevator is at a halt is stopped at a preset voltage, regardless of the temperature of the power storage unit 21. In the second embodiment, the voltage at which the charging from the commercial power source 1 during a halt of an elevator is stopped is changed based on the temperature of the power storage unit 21. This arrangement will provide the same advantages and also permits improved acceptability of regenerative electric power especially at low temperatures because charging from the commercial power source 1 can be stopped in substantially the same charge state.

Figure 5:
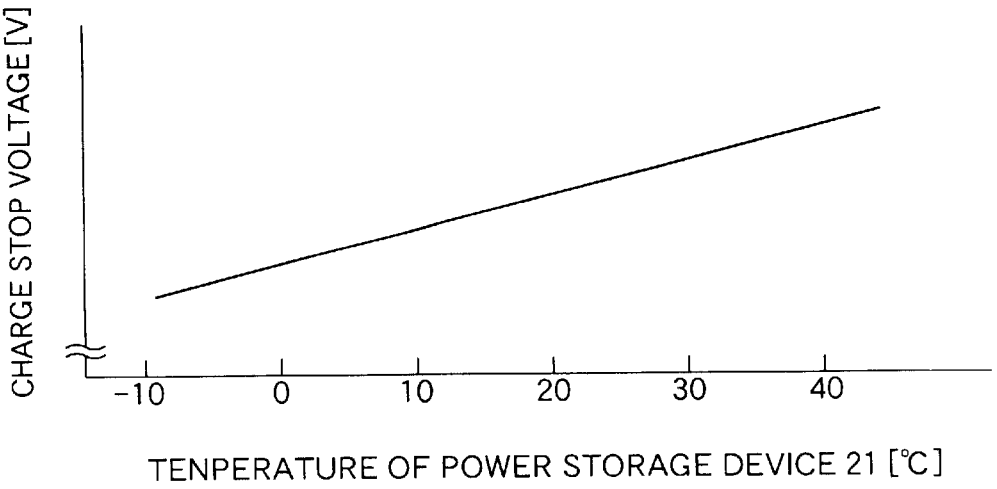
FIG. 5 is a diagram illustrating a relationship between temperatures of a power storage unit and charge stop voltages in an elevator control apparatus according to a second embodiment of the present invention.

FIG. 5 is a diagram illustrating a relationship between temperatures of a power storage unit 21 and charge stop voltages in an elevator control apparatus according to a second embodiment of the present invention.

When the power storage unit 21 is provided with a thermometer, such as a thermister 32, and the voltage at which charging from the commercial power source 1 during a halt of the elevator is changed according to the temperature of the power storage unit 21, as shown in FIG. 5, the state of charge can be controlled further accurately if the power storage unit 21 is formed of a battery.

For instance, in the case of a sealed lead battery, if the charge stop voltage at 25 degrees Celsius of the power storage unit 21 is denoted as V25, a temperature coefficient K is provided, and a charge stop voltage Vstop is changed based on a temperature TB according to a linear function expression (1) shown in FIG. 5, then the charge from the commercial power source 1 can be stopped in substantially the same state of charge.

$$V\text{stop}=V25+K(25-TB) \quad (1)$$

Thus, regardless of the temperature of the power storage unit 21, good acceptability of regenerative electric power can be maintained.

Third Embodiment

In the first embodiment, the state of charge is computed based on the detected value Ic of charge and discharge currents to detect the state of charge of the power storage unit 21. In a third embodiment, a value of the state of charge is corrected when a predetermined charge stop voltage is reached during a constant-current charging from the commercial power source 1 performed during a halt of an elevator. This arrangement permits further accurate control of the state of charge of the power storage unit 21. The correction is performed in the same manner mainly as in a fourth embodiment, which will be discussed later.

Accumulated errors in charge and discharge current amounts (unit in ampere-hour (Ah)) due to detection errors in the charge and discharge current Ic or errors in charging time, etc. prevent accurate detection of the state of charge. This may lead to a failure of supply of necessary power in case of a power failure, or deteriorated acceptability of regenerative electric power. Furthermore, deterioration, a shortened life, or breakdown of the power storage unit 21 may result. A more accurate value of a charge state can be obtained by correcting the value of a charge state to a predetermined value when a predetermined stop voltage is reached during charging at a constant current from the commercial power source 1 while the elevator is at a halt.

Fourth Embodiment

In the third embodiment, the value of a charge state of the power storage unit 21 is corrected when a predetermined stop voltage is reached during a constant-current charge from the commercial power source 1 while the elevator is at a halt. In a fourth embodiment, when a preset time elapses immediately after a discharge from the power storage unit 21 for operating an elevator is completed, a value of a charge state is corrected based on an open circuit voltage of the power storage unit 21. This arrangement provides the same advantages as those of the third embodiment, and allows a value of a charge state to be corrected more frequently, thus permitting more accurate control of the state of charge.

Figure 6:
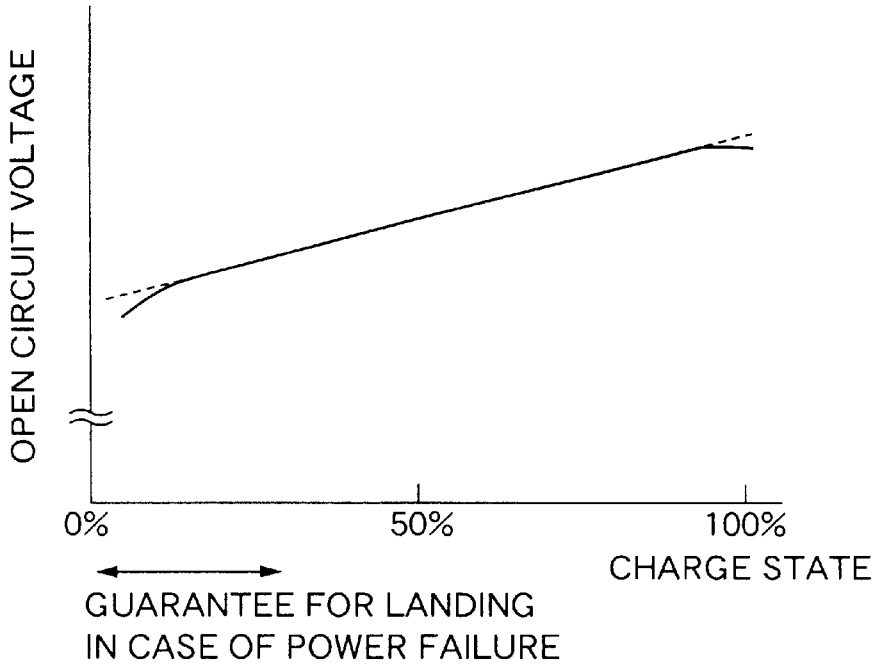
FIG. 6 is a diagram illustrating a relationship between an open circuit voltage of a power storage unit and a state of charge in an elevator control apparatus according to a fourth embodiment of the present invention.

FIG. 6 is a diagram illustrating a relationship between open circuit voltages of a power storage unit 21 and states of charge of the power storage unit 21 when the predetermined time has passed after a discharge of the power storage unit 21.

As shown in FIG. 6, the open circuit voltages of the power storage unit 21 when a predetermined time, e.g. a few tens of seconds or more, has elapsed immediately following a required discharge from the power storage unit 21 to operate the elevator have a substantially linear function relationship relative to the states of charge of the power storage unit 21.

The above relationship can be approximated to the linear function especially within a standard range of charge states defined by upper and lower limit values of a state of charge for ensuring a discharge capacity required for landing in case of a power failure and for permitting satisfactory acceptability of regenerative electric power.

Using the aforesaid characteristics, an open circuit voltage Vb of the power storage unit 21 is detected during a halt of the elevator after a discharge for operating the elevator, and based on the detected open circuit voltage, the state of charge of the power storage unit 21 is corrected according to FIG. 6. In other words, the state of charge of the power storage unit 21 is updated based on the new open circuit voltage. The correction may be made each time or for a predetermined number of times. Alternatively, the correction may be made under a certain condition, e.g. only if a computed value of the charge state and a value of a charge state based on FIG. 6 indicate a predetermined error or more.

As an alternative, the relationship between the open circuit voltages after predetermined times elapse following discharges and charge states may be tabled in advance, and values of charge states may be corrected based on the table.

Fifth Embodiment

In the fourth embodiment discussed above, a value of a charge state is corrected using an open circuit voltage of the power storage unit 21 after a preset time elapses immediately following a discharge from the power storage unit 21 is performed to operate an elevator. In a fifth embodiment, a value of a charge state is corrected by an open circuit voltage of the power storage unit 21 after a preset time elapses immediately following a charge from the power storage unit 21. This arrangement will provide the same advantages as those of the fourth embodiment.

The open circuit voltages of the power storage unit 21 when a predetermined time, e.g. a few tens of seconds or more, has elapsed immediately following a charge during a halt of an elevator or a charge of regenerative electric power in a regenerative operation mode of the elevator is performed have a substantially linear function relationship relative to the states of charge of the power storage unit 21, almost as in the case shown in FIG. 6 referred to in the foregoing fourth embodiment.

The above relationship can be approximated to the linear function especially within a standard range of charge states defined by upper and lower limit values of a state of charge for ensuring a discharge capacity required for landing in case of a power failure and permitting satisfactory acceptability of regenerative electric power.

Using the aforesaid characteristics, an open circuit voltage Vb of the power storage unit 21 is detected during a halt of the elevator after a charge, and based on the detected open circuit voltage, the state of charge of the power storage unit 21 is corrected according to the open circuit voltage and charge state characteristics. The correction may be made each time or for a predetermined number of times. Alternatively, the correction may be made under a certain condition, e.g. only if a computed value of a charge state and a value of a charge state based on the open circuit voltage and charge state characteristics indicate a predetermined error or more.

As an alternative, the relationship between the open circuit voltages after predetermined times elapse following charges and the charge states may be tabled in advance, and values of charge states may be corrected based on the table.

As another alternative, a thermometer, such as a thermistor 32, may be used to detect the temperature of the power storage unit 21, and the values of charge states of the power storage unit 21 may be corrected based on the temperature of the power storage unit 21 and the open circuit voltage Vb of the power storage unit 21.

The characteristics are such that the open circuit voltage following a charge increases especially when the temperature of the power storage unit 21 is low, namely, below about 5 degrees Celsius. Hence, the values of charge states of the power storage unit 21 can be corrected further accurately at low temperatures by taking advantage of the open circuit voltage and charge state characteristics relative to the temperature of the power storage unit 21. The correction may be made each time or for a predetermined number of times. Alternatively, the correction may be made under a certain condition, e.g. only if a computed value of a charge state and a value of a charge state based on the open circuit voltage and charge state characteristics indicate a predetermined error or more.

The relationship between the temperature of the power storage unit 21, the open circuit voltages after predetermined times elapse following charges, and the charge states may be tabled in advance, and values of charge states may be corrected based on the table.

Sixth Embodiment

In the first embodiment discussed above, in order to improve the acceptability of regenerative electric power, charging is stopped when a predetermined voltage is reached during charging performed while an elevator is at a halt. In a sixth embodiment, there are provided a charge target indicating means installed on a charge/discharge control circuit 23 or a controller 8 or an independently installed charge target indicating device 41 that indicates a charge target value of a power storage unit 21, and a means for detecting a charge state of the power storage unit 21 (the means may be a part of software in the charge/discharge control circuit 23). If a charge state is higher than a charge target value, then discharging is performed by supplying the corresponding excess energy from the power storage unit 21 to lighting in an elevator car, an inverter control circuit 13, or a charge/discharge control circuit 23 thereby to improve the acceptability of regenerative electric power.

Figure 7:
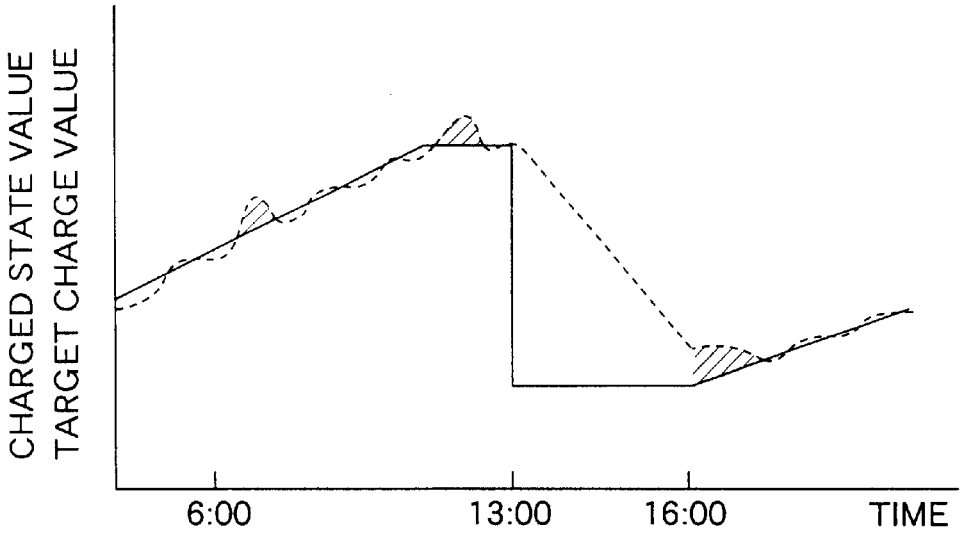
FIG. 7 is a diagram showing time, charge target values, and charge states in an elevator control apparatus according to a sixth embodiment of the present invention.

FIG. 7 is a diagram showing an example of a charge target value (indicated by the solid line) indicated by the charge target indicating device 41 relative to time, and an example of charge states (indicated by the dashed line) of the power storage unit 21 in an elevator control apparatus according to the sixth embodiment of the present invention.

Based on the charge target values indicated by the solid line of FIG. 7 received from the charge target indicating device 41, charging is performed by a charge circuit of a charge/discharge circuit 22 during a halt of the elevator thereby to control the charge state.

In a regenerative operation mode of the elevator, the power storage unit 21 is charged with regenerative electric power by the charge circuit of the charge/discharge circuit 22 irrespectively of a charge target value. Hence, there are cases where actual charge state values become considerably higher than the charge target values, as shown by the dashed line of FIG. 7.

If a charge state value exceeds a charge target value by a predetermined level or more, then the charge energy indicated by hatches of FIG. 7 is supplied from the power storage unit 21 to the lighting in an elevator car, the inverter control circuit 13, or the charge/discharge control circuit 23 so as to bring the charge state value closer to the charge target value. Thus, good acceptability of regenerative electric power can be always maintained.

Seventh Embodiment

In the sixth embodiment described above, the charge state is controlled by providing the charge target indicating device 41 that indicates a charge target value of the power storage unit 21 and the means for detecting the charge state of the power storage unit 21. According to a seventh embodiment, the charge state of the power storage unit 21 is controlled by a remote monitoring unit, such as a personal computer 42, by using a wire communication line or radio communication. This arrangement makes it possible to detect a failure and to know when to replace the power storage unit 21.

Charge state values of the power storage unit 21 are transmitted to a remote monitoring unit installed at, for example, an elevator maintenance company or an elevator control room by using a wire communication line or radio communication. If the received charge state data regarding the power storage unit 21 is lower or higher than a predetermined charge state, then it is determined that a failure has taken place in the power storage unit 21, a charge/discharge circuit 22, or a charge/discharge control circuit 23, making it possible to show that an immediate inspection and repair is required.

Furthermore, if a result of correcting a charge state based on an-open circuit voltage of the power storage unit 21 as discussed in the above fourth or fifth embodiment indicates that a low charge state remains unchanged even after charging is carried out based on a charge target value of the power storage unit 21, or if the charge state data transmitted to the remote monitoring unit stays lower than a predetermined charge state for a predetermined period of time, then it is determined that a failure has taken place in the power storage unit 21, a charge/discharge circuit 22, or a charge/discharge control circuit 23, or that the life of the power storage unit 21 has expired, thus making it possible to show that an immediate inspection and repair is required, or that the power storage unit 21 must be replaced.

In addition, remote inspection is carried out from the remote monitoring unit to measure a charge amount until a preset voltage corresponding to a predetermined discharge amount of the power storage unit 21 is reached, charge current amount efficiency is calculated, and the calculated charge current amount efficiency is compared with standard charge current amount efficiency. This makes it possible to predict a life of the power storage unit 21 from a drop in the charge current amount efficiency so as to know when to replace the power storage unit 21.

Moreover, it is also possible to provide a control panel or a hoistway or the like with a means for externally displaying the charge state of the power storage unit.21 so as to let service personnel know during maintenance by using, for example, an LCD or LED display device 43 driven by the charge/discharge control circuit 23, that the charge state has dropped below a predetermined level or a low charge state has continued, enabling the service personnel to easily decide whether or not the power storage unit 21 need to be replaced.

What is claimed is:

1. An elevator control apparatus comprising:

a converter for rectifying AC power into DC power;

an inverter for converting the DC power into AC power having a variable voltage and a variable frequency;

a power storage unit connected to the converter and the inverter for storing DC power produced by the converter and for supplying DC power to the inverter for producing the AC power having a variable voltage and a variable frequency;

a controller for controlling a motor driven by the AC power having the variable voltage and the variable frequency, the motor operating an elevator, the controller controlling supply of power simultaneously and independently from each of the converter and the DC power storage unit to the elevator;

a charge/discharge control circuit controlling a state of charge of the power storage unit, outputting a drive signal to charge the power storage unit with the DC power from the converter only when the elevator is stopped, based on operational information regarding the elevator received from the controller, and outputting a stop signal to stop charging of the power storage unit when a voltage of the power storage unit reaches a preset voltage; and a charge/discharge circuit for starting charging of the power storage unit with the DC power in response to the drive signal, and stopping charging of the power storage unit in response to the stop signal.

2. The elevator control apparatus according to claim 1, further comprising temperature detecting means for detecting temperature of the power storage unit wherein the charge/discharge control circuit changes the preset voltage based on the temperature of the power storage unit detected by the temperature detecting means.

3. The elevator control apparatus according to claim 1, wherein the charge/discharge control circuit corrects the state of charge of the power storage unit when the voltage of the power storage unit reaches the preset voltage.

4. The elevator control apparatus according to claim 2, wherein the charge/discharge control circuit corrects the state of charge of the power storage unit when the voltage of the power storage unit reaches the preset voltage.

5. The elevator control apparatus according to claim 1, wherein the present voltage indicates a state of charge of the power storage unit at less than 100%, whereby regenerative power generated by the motor in a regenerative operation of the elevator can charge the power storage while the elevator is moving.

* * * * *